United States Patent [19]

Shadoan

[11] Patent Number: 4,696,505

[45] Date of Patent: Sep. 29, 1987

[54] HANDLE AND STRAP APPARATUS FOR HAND-CARRYING ARTICLES

[76] Inventor: Ralph E. Shadoan, 12537 SE. 38th St., Choctaw, Okla. 73020

[21] Appl. No.: 928,978

[22] Filed: Nov. 10, 1986

[51] Int. Cl.[4] ..... A45C 13/26; B65D 71/00

[52] U.S. Cl. ..... 294/153; 294/156; 294/167

[58] Field of Search ..... 294/153, 152, 156, 171, 294/157, 154, 149, 164, 167, 170, 26, 15, 92

[56] References Cited

U.S. PATENT DOCUMENTS

| | | | |
|---|---|---|---|
| 1,335,888 | 5/1920 | Fulton . | |
| 1,916,793 | 7/1933 | Harper . | |
| 2,486,827 | 11/1949 | Duncan | 150/1.5 |
| 2,819,923 | 1/1958 | Anderson | 294/74 |
| 3,400,870 | 9/1968 | Di Vietri | 224/58 |
| 3,554,417 | 1/1971 | Yorty | 224/45 |
| 4,558,896 | 12/1985 | Farnworth | 294/156 |

*Primary Examiner*—James B. Marbert

*Attorney, Agent, or Firm*—Hubbard, Thurman, Turner & Tucker

[57] ABSTRACT

A device for hand-carrying articles includes a metal carrying handle and an elongated carrying strap. The handle has a pair of spaced apart, elongated side sections which extend along and are positioned on opposite sides of handle axis. The side sections are interconnected at their upper ends by a handgrip portion which extends transversely to the axis, at their lower ends by a lower crossbar which has an elongated slot formed therethrough, and at longitudinally intermediate portions thereof by a central crossbar to which is anchored an end portion of the carrying strap. To carry an article, the strap is looped around the article to define a carrying loop portion of the strap. The free end of the strap is then passed over the lower handle crossbar and then back through the crossbar slot to define in the strap a strap connecting loop portion. When the handle is lifted, the connecting loop portion is frictionally locked to the lower crossbar to prevent enlargement of the strap carrying loop. The carrying loop may be rapidly tightened or loosened by simply pulling an appropriate portion of the strap outwardly from the handle at an angle to its axis. An auxiliary handle is provided for instances in which two handles are needed to carry the article.

17 Claims, 6 Drawing Figures

HANDLE AND STRAP APPARATUS FOR HAND-CARRYING ARTICLES

BACKGROUND OF THE INVENTION

The present invention relates generally to article-carrying devices, and more particularly provides a uniquely configured handle and strap apparatus for hand-carrying heavy and/or bulky articles such as packing boxes used in moving household goods.

As is well known, the hand-carrying of heavy and/or bulky articles not provided with integral handles can be a difficult, awkward and often uncomfortable task typically requiring the use of both hands. The hand-carrying of packing boxes, such as those used in housheold moves, is but one example of this problem.

One solution to this problem would be to simply tie a cord (or other flexible carrying member) around the packing box and then lift the box by the cord. For various reasons, however, this solution is not altogether satisfactory. For example, if the loaded packing box (or other article) is even moderately heavy, the cord soon begins to cause discomfort in the carrying hand or hands. Additionally, it can be a time-consuming task to tie and knot cords around each packing box to be carried.

A variety of article-carrying or hanging devices have heretofore been proposed, as exemplified in U.S. Pat. Nos. 1,335,888; 1,916,793; 2,486,827; 2,819,923; 3,400,870; 3,554,417; and 4,558,896, which provide a flexible member, such as a strap, rope or cable, that may be wrapped around the article to be carried, and a handle or other rigid member associated in some manenr with the flexible member.

However, none of these conventional carrying devices adequately provide for the comfortable hand-carrying of heavy and/or bulky objects of widely varying sizes such as packing boxes. Specifically, such conventional hand-carrying devices either have only limited adjustment capability, are of relatively complex design, do not have handle portions which would be comfortable to use while carrying heavy loads, or are simply not designed for hand-carrying objects at all.

It is accordingly an object of the present invention to provide improved apparatus for hand-carrying objects which eliminates or minimizes the above-mentioned and other problems and limitations typically associated with conventional hand-carrying devices.

SUMMARY OF THE INVENTION

In carrying out principles of the present invention, in accordance with a preferred embodiment thereof, improved apparatus is provided for hand-carrying articles and comprises a rigid handle and an elongated carrying strap. The handle has a spaced apart pair of side sections which extend along and are positioned on opposite sides of an axis. The side sections are interconnected at axially aligned upper end portions thereof by a grip portion of the handle which extends generally transversely to the axis. Lower end portions of the side sections are interconnected by a lower transverse crossbar portion of the handle which has an elongated strap slot formed therethrough. Positioned between the grip portion and the lower crossbar portion is a central crossbar portion which also extends transversely to the axis and is interconnected at its opposite ends to the handle side sections.

An end portion of the carrying strap is looped around the central handle crossbar and then secured to itself to thereby anchor the carrying strap to the handle. To hand-carry an article such as a loaded packing box with the handle-and-strap apparatus, the carrying strap is looped around the article to define a carrying loop which will support the article as it is being carried. The free end of the strap is then passed over the lower handle crossbar and then threaded back through the strap slot therein to thereby form a connecting loop portion in the strap which extends around the upper portion of the lower handle crossbar. The carrying loop is then tightened around the article to be carried by pulling the free end of the strap outwardly from the handle at at least a slight angle relative to its axis. With the handle positioned generally centrally relative to the article to be carried, the grip portion of the handle is grasped and lifted to carry the article.

The downward weight of the carried article on the strap carrying loop, in a direction generally parallel to the handle axis, frictionally locks the connecting loop portion of the strap to the lower handle crossbar, thereby preventing lengthening of the carrying loop portion of the strap. When the article is rested upon a supporting surface so that its weight is removed from the carrying loop, the carrying loop may be enlarged to permit its removal from the article by simply pulling a portion of the carrying loop away from the handle at at least a slight angle to the handle axis, thereby moving a free end portion of the strap through the strap slot and the handle. The strap may be then removed from the article and connected to another article to be carried.

According to another aspect of the present invention an auxiliary handle is provided for use with the handle-and-strap apparatus to quickly provide a second carrying handle on the carrying strap. The auxiliary handle has a pair of side sections which are interconnected at lower end portions thereof by a lower transverse crossbar portion having a slightly wider strap slot formed therein. One of the side sections has a lateral opening formed therethrough which communicates with such strap slot. the other side section also has a lateral opening formed therethrough above the lower crossbar, such lateral opening communicating with the handle opening defined by the side sections, the lower crossbar, and a grip portion which extends transversely between the side sections at upper end portions thereof.

With the main handle-and-strap apparatus connected to the article to be carried as previously described, the auxiliary handle is connected to the carrying loop portion of the strap by inserting portions of the carrying loop inwardly through the lateral side section openings in the auxiliary handle to thereby form a connecting loop portion in the strap which is wrapped around the upper portion of the lower crossbar in the auxiliary handle. When the two handles are lifted, the two connecting loop portions in the carrying strap are each frictionally locked to the lower crossbar of its associated carrying handle. When the carried object is again rested on a supporting surface, the auxiliary handle may be quickly disconnected from the carrying strap simply by tilting the handle on its side and pulling the strap outwardly through the lateral openings in the auxiliary handle. The first handle and the carrying strap may then be removed from the article as previously described.

Two of the auxiliary handles may also be used to carry an article by using a carrying strap which is not anchored to either of the handles. To carry the article in this manner, the carrying strap is looped around the article and then passed over itself to form a doubled strap portion above the article. One of the auxiliary handles is then connected to the doubled strap portion by passing it through the handle's lateral side sectioon openings as previously described, and the other auxiliary handle is connected as previously described to the carrying loop portion of the strap. The two handles are then lifted to thereby cause connecting loop portions of the strap to be frictionally locked to the lower crossbars of the auxiliary handles. When the article is again rested on a supporting surface, each of the auxiliary handles may then be quickly removed from the carrying strap by pulling it outwardly through the lateral side section openings in the auxiliary handles.

In both the main and auxiliary handles, lower ends of the handle side sections define with the lower crossbar a lower handle end notch which, during carrying of the article, receives and laterally restrains a portion of the carrying strap to help stabilize the handle relative to the strap's carrying loop portion.

DETAILED DESCRIPTION

Figure 1:
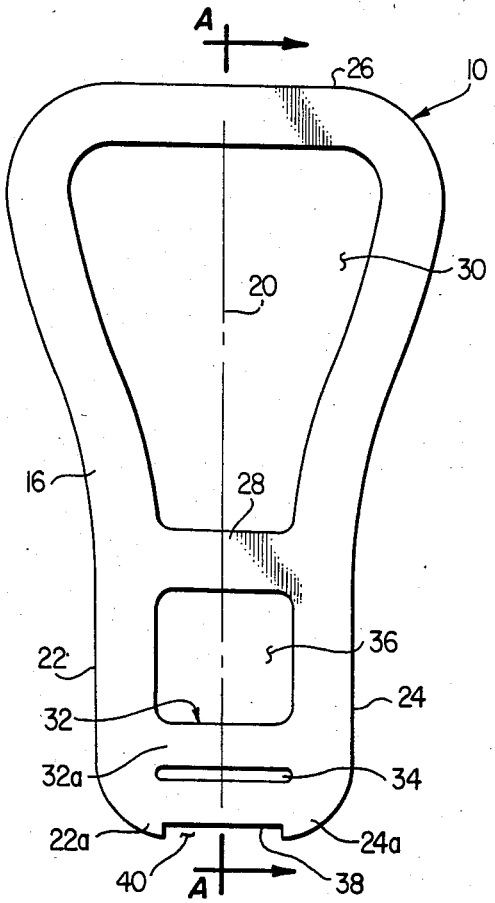
FIG. 1 is an elevational view of an article-carrying handle which embodies principles of the present invention.
Figure 2:
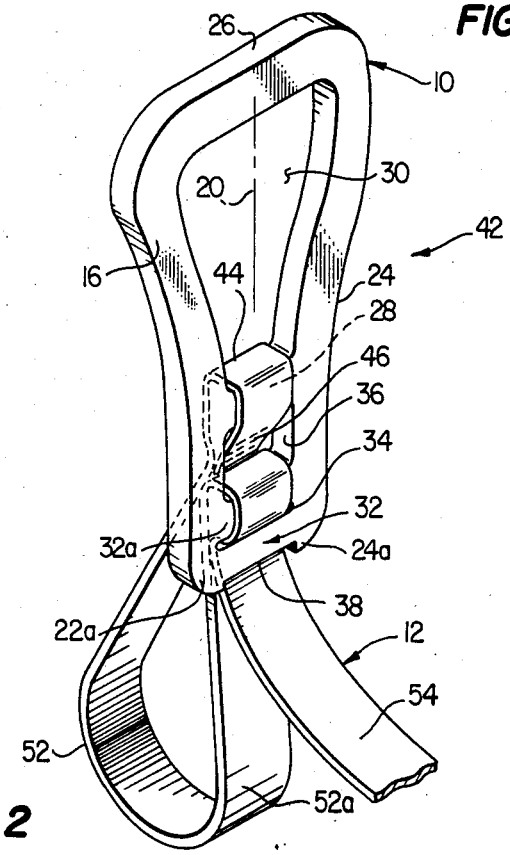
FIG. 2 is a perspective view of the handle operatively connected to a carrying strap.
Figure 3:
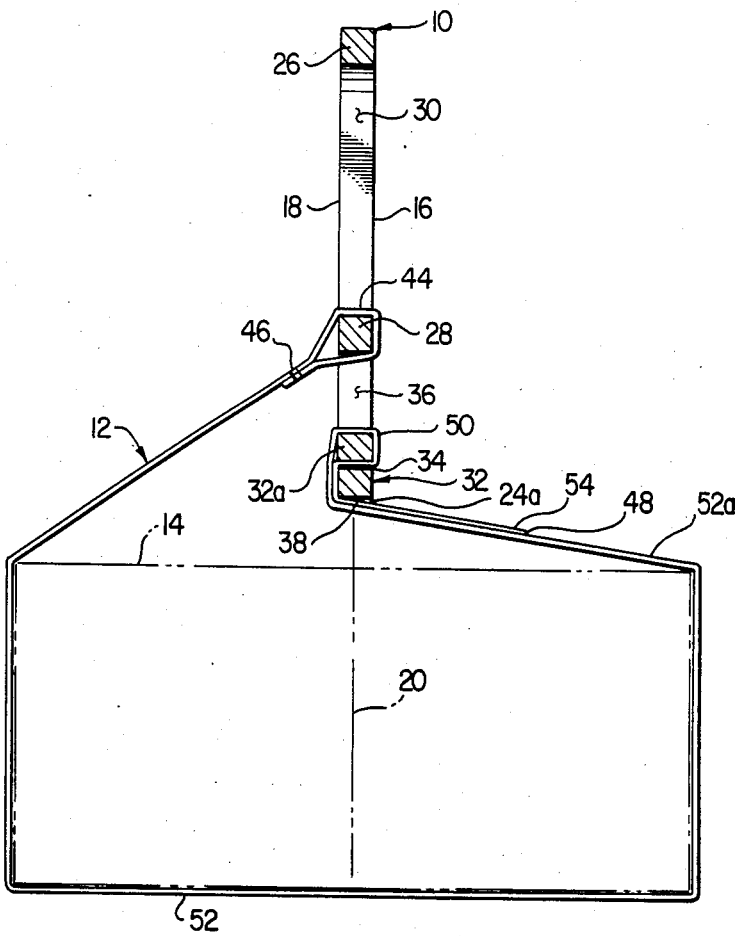
FIG. 3 is a cross-sectional view through the handle taken along line A—A of FIG. 1 and illustrates the handle and strap being operatively connected to a loaded packing box, illustrated in phantom, for hand-carrying the box.

Referring to FIGS. 1-3, the present invention provides a uniquely configured one-piece metal carrying handle 10 which is utilized in conjunction with an elongated, flexible carrying member in the form of a strap 12 to conveniently and comfortably hand-carry a heavy and/or bulky article such as a loaded packing box 14 which is illustrated in phantom in the drawings. Handle 10 is of a generally stirrup-shaped configuration and has a front surface 16, a rear surface 18, and a pair of laterally spaced side sections 22, 24 which are positioned on opposite sides of and extend along the axis 20. As illustrated, upper portions of the side sections 22, 24 are curved laterally outwardly and then laterally inwardly at their upper ends which are joined by a laterally extending grip portion 26 which is sized to be conveniently and comfortably grasped by the hand of a user of the handle.

Vertically intermediate portions of the side sections 22, 24 are intersecured by a laterally extending crossbar portion 28 of the handle, handle portions 26, 28 defining with the curved upper portions of the handle side sections an upper opening 30 through the handle. Lower portions of the side sections 22, 24 extend parallel to the axis 20, and at their lower ends $22_a$, $24_a$ are laterally narrowed. Intersecuring the lower side section portions between the central crossbar 28 and the lower side section ends $22_a$, $24_a$ is a lower crossbar portion 32 which has an opening formed therethrough in the form of a laterally elongated slot 34. The central and lower crossbar portions 28, 32 define with the handle side sections a generally rectangular opening 36 through the handle. The lower side section ends $22_a$, $24_a$ define with the lower surface 38 of the crossbar 32 a lower end notch 40 in the handle 10.

To form the handle-and-strap assembly 42 depicted in FIGS. 2 and 3, an end portion 44 of the strap 12 is looped around the center crossbar 28 and then secured to itself, as by stitch lines 46, to thereby anchor the strap end portion 44 to the handle 10. The free end 48 of the strap 12 is then passed forwardly through the central handle opening 36, over the upper longitudinal portion $32_a$ of the lower crossbar 32, and then rearwardly through the slot 34. This forms in the strap 12 a connecting loop portion 50 wrapped around the crossbar portion $32a$, a carrying loop portion 52 extending between the upper crossbar 28 and the connecting loop 50, and a free end portion 54 of the strap which extends between the connecting loop 50 and the free strap end 48.

With no weight load thereon, the carrying loop 52 depicted in FIG. 2 may be enlarged (i.e., loosened) by pulling the right carrying loop portion $52_a$ away from the handle 10 at at least a slight leftward angle relative to the handle axis 20. This pulls an inner portion of the free strap end portion 54 through the slot 34 to thereby enlarge the carrying loop 52 and shorten the free end portion 54, while also effectively moving the connecting loop portion 50 closer to the free strap end 58. In a similar manner, the carrying loop 52 may be shortened (i.e., tightened) by simply pulling on the free strap end portion 54.

With the carrying loop 52 suitably adjusted, it is slipped over the box 14 (FIG. 3) with the handle 10 positioned generally centrally along the upper end of the box. The carrying loop 52 is then snugly tightened around the box 14 by pulling on the free strap end 54. The grip portion 26 of a handle 10 may then be grasped and lifted to carry the box away.

The vertical force of the box's weight, which is exerted on the carrying loop in a direction generally parallel to the handle axis 20, automatically causes the connecting loop 50 to be frictionally locked against the lower crossbar 32 which functions as means for creating such frictional lockage. This prevents undesired lengthening of the carrying loop 12 while the box is being carried prevent the box from slipping out of the carrying loop. When the box is again rested on a supporting surface to thereby remove its weight load from the carrying loop 52, the carrying loop may be rapidly lengthened to permit its removal from the box by simply tilting the handle 10 slightly leftwardly away from its vertical position depicted in FIG. 3 and pulling on the strap portion $52_a$. The carrying loop 52 may then be removed from the box and slipped over another box which is carried away in a similar manner. As can be best seen in FIG. 3, the lower handle end notch 40 functions to prevent lateral slippage of the carrying strap portion received therein relative to the handle 10 during the carrying process, the handle end portions $22_a$, $24_a$ functioning as lateral stops for such strap portion.

At this point, several advantages of the handle 10 should be noted. First, it is of a very simple and relatively inexpensive construction. Furthermore, the handle has incorporated therein means for frictionally locking the connecting loop portion 50 of the strap without the use of buckle mechanisms or in any manner wedging the strap between the handle and the article being carried. Stated otheriwse, the frictional lockage between the carrying strap and the handle is effected by the lower crossbar member 32 even though it is spaced slightly upwardly from the box during carrying thereof. The handle is very strong, durable and comfortable to use and renders even fairly heavy and/or bulky articles relatively easy to carry with only one hand. Additionally, it permits very rapid tightening or loosening of the carrying strap around the article to be carried without the necessity of buckle mechanisms or other similar adjusting mechanisms. Finally, because the carrying strap is anchored to the handle, the likelihood of losing or misplacing either component is reduced.

As just described, the handle 10 conveniently provides for the comfortable one-handed carrying of even fairly bulky and/or heavy articles. However, in many instances, due to either the size or weight of the article to be carried, it would be necessary or desirable to provide two handles which may be connected to the carrying strap, and frictionally locked thereto, so that such article may be carried by either a single person using two hands, or by two people each holding one of the handles. To permit this hand-carrying technique, the present invention provides an auxiliary handle $10_a$ which comprises an alterante embodiment of the previously described handle 10.

Figure 4:
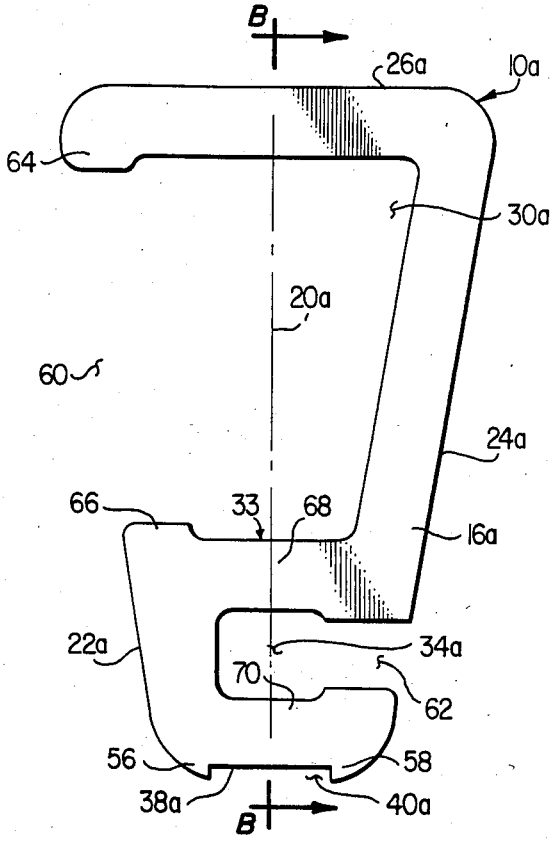
FIG. 4 is an elevational view of an alternate embodiment of the handle.

As can be seen in FIG. 4, the handle $10_a$ is a slightly modified, and somewhat simplified version of the handle 10. Like the handle 10, the handle $10_a$ has a longitudinal axis $20_a$ a front surface $16_a$ a rear surface $18_a$, and side sections $22_a$, $24_a$ (which are substantially straight, and angled relative to the axis $20_a$) that are interconnected at their upper ends by a laterally extending grip portion $26_a$. A lower crossbar portion 33 interconnects the side sections $22_a$, $24_a$, immediately above the laterally reduced lower ends 56, 58 of the side sections $22_a$, $24_a$. The lower side section ends 56, 58 define with the lower surface $38_a$ of the lower crossbar member 33 a lower end notch $40_a$ in the handle $10_a$. Above the crossbar 33, the side sections $22_a$, $24_a$ define with the grip portion $26_a$ an upper handle opening $30_a$.

The crossbar 33 is vertically wider than the lower crossbar 32 of handle 10, and has formed therein a slot $34_a$ which is vertically wider than the slot 34. A wide lateral opening 60, which communicates with the handle opening $30_a$, is formed through the side section $22_a$ above the crossbar $32_a$. A smaller lateral opening 62 is formed through a lower end portion of the side section $24_a$ and communicates with the widened slot $34_a$. The formation of the lateral opening 60 in the side section $22_a$ defines vertically facing stub portions 64, 66 of the side section $22_a$. In a manner similar to that of the slot 34 of handle 10, the slot $34_a$ and handle $10_a$ defines in the crossbar 33 an upper portion 68 and a lower portion 70.

Figure 5:
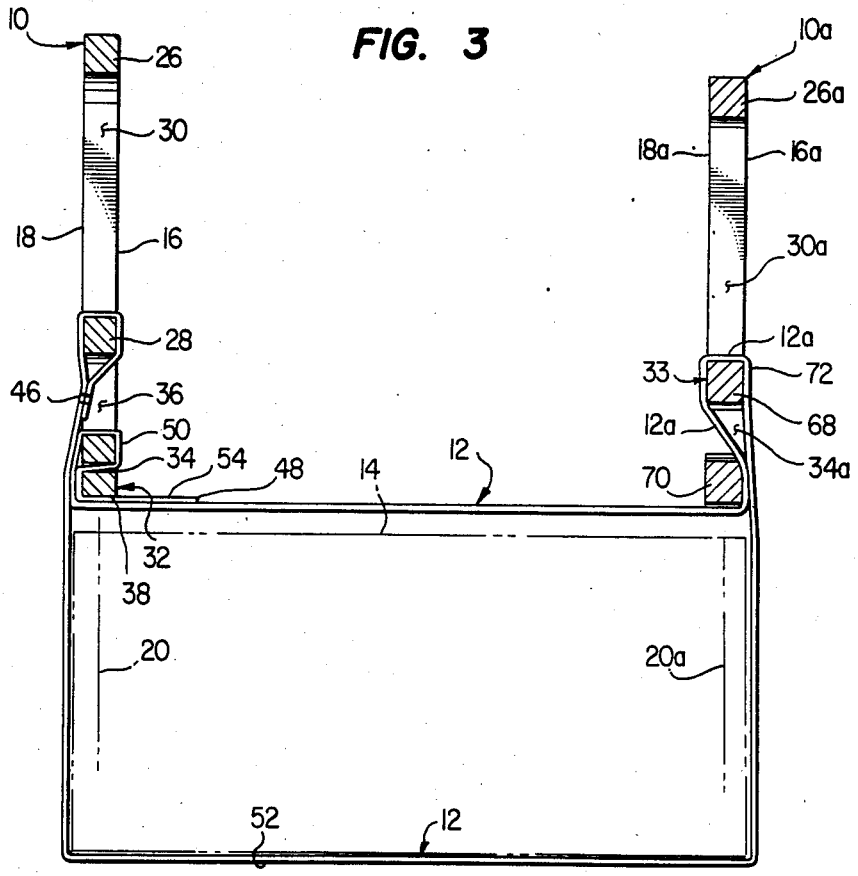
FIG. 5 is a cross-sectional view through the handles of FIG. 1 and FIG. 4, taken respectively along lines A—A and B—B of FIGS. 1 and 4, and depicts the two handles being connected to a-carrying strap and used together to carry a loaded packing box.

To utilize the auxiliary handle $10_a$ in conjunction with the handle 10, as depicted in FIG. 5, the handle 10, and the strap 12 secured thereto, are first connected to the box 14 as previously described. However, before the strap 12 is tightened around the box 14, the handle 10 is moved to a position adjacent the upper left corner of the box 14 (as viewed in FIG. 5). The strap 12 is then partially tightened around the box 14. Next, the auxiliary handle $10_a$ is positioned adjacent the right upper corner of the box 14 and is tilted away from the handle 10. A portion $12_a$ of the strap 12 is then inserted through the handle opening 60 into the opening $30_a$, and a strap portion $12_b$ is inserted through the opening 62 into the slot $34_a$. Finally, the auxiliary handle $10_a$ is tilted upwardly to its vertical position depicted in FIG. 5, thereby further tightening the strap 12 around the box 14 and forming in the strap 12 a connecting loop portion 72 which is frictionally locked to the crossbar 33 when the handle $10_a$ is pulled upwardly. The box 14 may be then carried away by grasping the grip portions 26, $26_a$ of the handles 10 and $10_a$.

The carrying loop portion 52 is locked, during the carrying of the box 14, by both the main handle 10 and the auxiliary handle $10_a$. When the box 14 is again rested upon a supporting surface, the auxiliary handle $10_a$ may be easily and quickly removed from the strap 12 by tilting the handle leftwardly and then removing the strap 12 by pulling the strap portions $12_a$, $12_b$ outwardly through the side section openings 60 and 62. The main handle 10 may also then be removed. While the box is being carried, the lower end notch $40_a$ in handle $10_a$ functions to laterally restrain the strap portion therein, while the side section stub 66 functions to retain the strap portion $12_a$ within the opening $30_a$. The downwardly projecting side section stub 64 functions to prevent the user's hand from slipping off the handle grip portion $26_a$.

Figure 6:
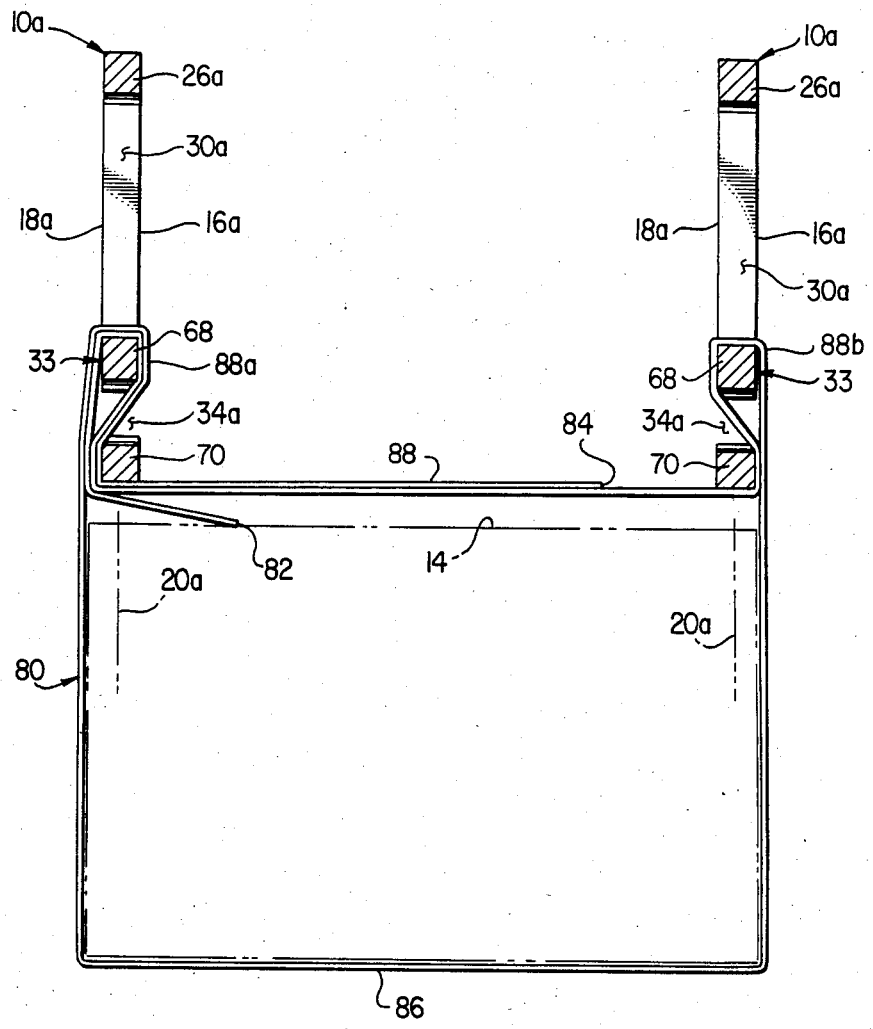
FIG. 6 is a cross-sectional view through simliar to that in FIG. 5, but with two handles of the type depicted in FIG. 4 being utilized together.

If desired, two of the auxiliary handles, $10_a$ and $10_a'$, may be used in conjunction with a strap 80 (FIG. 6) which is not anchored to either of the handles, and has free ends 82, 84. To utilize the auxiliary handles $10_a$ and $10_b$ in this manner, a central portion of the strap 80 is passed under the box 14 to form in the strap a carrying loop 86. The free end portions of the strap 80 are then passed over each other to define a doubled strap portion 88 which overlies the upper end of the box 14. Next, the auxiliary handle $10_a$ is connected to the doubled strap portion 88, as previously described, adjacent the upper left corner of the box 14 as viewed in FIG. 6. This creates in the doubled strap portion 88 a connecting loop portion $88_a$ which is frictionally locked to the crossbar portion 33 of handle $10_a$ when such handle is lifted. In a similar manner, the handle $10_a'$ is connected, as previously described, to the strap adjacent the upper right corner of the box 14 to create in the non-doubled strap portion a connecting loop portion $88_b$ which is frictionally locked to the crossbar portion 33 of handle $10_a'$ when this handle is lifted. As the box 14 is being carried by the auxiliary handles $10_a$ and $10_a'$, the frictionally locked connecting loops $88_a$, $88_b$ prevent enlargement of the carrying loop 86. When the box 14 is again rested on a supporting surface, the handles $10_a$ and $10_a'$ may be simply slipped off the doubled strap portion 88 and the strap 80 removed from the box.

It can be seen from the foregoing that the present invention provides uniquely configured handle-an-strap apparatus which may be conveniently and comfortably used to hand-carry a variety of heavy and/or bulky article such as the illustrated loaded packing box 14. Such apparatus may be very rapidly connected to and disconnected from the article to be carried, and is very easily adjustable to adapt the apparatus to a variety of article sizes and shapes. Each of the illustrated handles is easy and relatively inexpensive to manufacture, and provides a very sturdy carrying member which provides a comfortable, rigid hand grip to facilitate the carrying of the article.

While the described handles have been illustrated as being used in conjunction with a strap, it will be appreciated that they could also be utilized with other elongated, flexible carrying elements such as ropes or cables. Each of the handles 10 and $\mathbf{10}_a$ could be modified for use with, for example, a carrying rope by making the handle openings 34 and $\mathbf{34}_a$ I of a suitably dimensioned round configuration, and laterally narrowing the lower handle notches 40 and $\mathbf{40}_a$.

The foregoing detailed description is to be clearly understood as given by way of illustration and example only, the spirit and scope of the present invention being limited solely by the appended claims.

What is claimed is:

1. Apparatus for hand-carrying an article, comprising:

a handle for use with an elongated flexible carrying member adapted to be formed into a carrying loop portion wrapped around the article and having an end portion, and a connecting loop portion, said handle having:

an axis;

a grip portion extending generally transversely to said axis and adapted to be grasped by a user of said apparatus; and connecting means, spaced apart from said grip portion, for anchoring a first portion of said handle to said end portion of said carrying loop and for adjustably connecting a second portion of said handle to said connecting loop portion of said carrying member in a manner such that:

(1) when said grip portion and said carrying loop portion are pulled in opposite directions generally parallel to said axis said connecting loop portion frictionally locks said carrying loop portion to said handle and prevents enlargement of said carrying loop portion, and (2) when tension on said carrying loop portion is relaxed it may be selectively lenghtened or shortened to adjustably loosen or tighten said carrying loop about the article, by pulling on a portion of said carrying member to shift the location of said connecting loop portion thereon.

2. The apparatus of claim 1 wherein said connecting means comprise a connecting portion of said handle which extends generally transversely to said axis and has an opening formed therethrough and adapted to receive a portion of said connecting loop portion.

3. The apparatus of claim 2 wherein said opening is an elongated slot, and said apparatus further comprises an elongated carrying strap having an end portion anchored to said handle.

4. The apparatus of claim 3 wherein said connecting portion of said handle has an outwardly opening end notch formed therein for receiving and laterally restraining a portion of said carrying strap.

5. A carrying handle for use with an elongated flexible carrying member to hand-carry an article, said flexible carrying member being adapted to be formed into a carrying loop to receive and support the article, said carrying handle comprising:

an elongated side member;

a grip member secured to a first end portion of said side member, projecting outwardly from said first end portion at an angle relative to said side member and extending generally transversely to an axis of said carrying handle, and being adapted to be grasped by a handle of a user of said carrying handle;

a connecting member secured to a second end portion of said side member and projecting outwardly therefrom in a direction generally parallel to said grip member; and means for securing said carrying handle to said carrying loop in a manner permitting rapid tightening or loosening thereof by pulling a portion of said carrying member outwardly from said carrying handle at an angle relative to said axis, and precluding lengthening of said carrying loop when said carrying loop and said carrying handle are pulled apart in a direction generally parallel to said axis, said means for securing said carrying handle to said carrying loop including means for frictionally locking a connecting loop portion of said carrying member to said connecting member.

6. The carrying handle of claim 5 wherein said means for securing further includes means for anchoring an end portion of said carrying member to said carrying handle, and said means for frictionally locking include an opening formed through said connecting member and adapted to receive a portion of said carrying member.

7. The carrying handle of claim 6 further comprising means for defining a notch in said connecting member for receiving and laterally restraining a portion of said carrying member.

8. Apparatus for hand-carrying an article, comprising:

a handle having:

an axis, first and second mutually spaced elongated side sections extending along and positioned on opposite sides of said axis and having axially aligned upper and lower end portions, a handgrip portion interconnected between said upper end portions of said first and second side sections, a lower crossbar portion interconnected between said lower end portions of said first and second side sections and having a slot formed therethrough which extends generally transversely to said axis, and a central crossbar portion interconnected between longitudinally intermediate portions of said first and second side sections; and an elongated carrying strap having a first end portion anchored to said central crossbar portion of said handle, and a second end portion which may be passed over said lower crossbar portion in a first direction, and then passed through said slot in an opposite direction, to form in said carrying strap a connecting loop frictionally lockable to said lower crossbar portion, and a carrying loop extending between said first end portion of said carrying strap and said connecting loop, said carrying loop being adjustable by pulling a portion of said carrying loop to reposition the location of said connecting loop thereon.

9. The apparatus of claim 8 wherein said handle is of a unitary metal construction.

10. The apparatus of claim 8 wherein said first and second side sections have lower ends which project downwardly beyond said lower crossbar portion and define therewith a lower end notch on said handle for receiving and laterally restraining a portion of said carrying strap when the article is being carried by said apparatus.

11. The apparatus of claim 8 wherein said end portion of said carrying strap is looped over said central crossbar portion and secured to itself.

12. The apparatus of claim 8 wherein said handgrip portion is longer than said lower crossbar portion.

13. A carrying handle usable with an elongated flexible carrying member to hand-carry and article, comprising:

a first portion extending generally tranversely to an axis of said carrying handle and having first and second end portions respectively disposed on first and second sides of said axis, said first portion defining on said carrying handle a handgrip;

a second portion extending generally transversely to said axis and having first and second end portions respectively disposed on said first and second sides of said axis, said second portion being spaced apart from said first portion in a first direction along said axis;

a third portion extending generally transversely to said axis and having first and second end portions respectively disposed on said first and second sides of said axis, said third portion being spaced apart from said second portion in said first direction along said axis;

a fourth portion extending between and interconnecting said first end portions of said first and second portions; and a fifth portion extending between and interconnecting said second end portions of said second and third portions, said second and third portions being relatively positioned and configured to engage and frictionally lock to said carrying handle a loop portion of said flexible carrying member when a portion of said carrying member is pulled away from said carrying handle in a direction generally parallel to said axis, said second, third and fifth portions of said carrying handle defining therein a slot which has an end opening positioned between said first end portions of said second and third portions of said carrying handle, whereby spaced sections of said loop portion may be releasably inserted into said carrying handle in opposite lateral directions through said end opening in said slot, and between said first and second portions of said carrying handle.

14. The carrying handle of claim 13 wherein said fourth portion is angled relative to said axis.

15. The carrying handle of claim 13 wherein said first and second end portions of said third portion define with the balance thereof a handle end notch which opens outwardly in said first direction.

16. The carrying handle of claim 13 wherein said second end portion of said second portion has a projecting portion thereon which extends toward said second end portion of said first portion.

17. The carrying handle of claim 13 wherein said second end portion of said first portion has a projecting portion thereon which extends toward said second end portion of said second portion.

* * * * *